US007000672B2

(12) United States Patent
Nien

(10) Patent No.: US 7,000,672 B2
(45) Date of Patent: Feb. 21, 2006

(54) VENETIAN BLIND OPERATED WITH NON-PULL CORD STRUCTURE

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 211 days.

(21) Appl. No.: 10/740,625

(22) Filed: Dec. 22, 2003

(65) Prior Publication Data

US 2005/0082017 A1 Apr. 21, 2005

(30) Foreign Application Priority Data

Oct. 17, 2003 (TW) ..... 92218494 U

(51) Int. Cl.
*E06B 9/307* (2006.01)

(52) U.S. Cl. ..... 160/172 R; 160/178.2; 160/84.06

(58) Field of Classification Search ..... 160/170, 160/171, 178.2, 172 R, 277, 278, 279, 84.04, 160/84.05, 84.06
See application file for complete search history.

(56) References Cited

U.S. PATENT DOCUMENTS 911,982 A * 2/1909 Hopkins ..... 160/278
1,797,162 A * 3/1931 Stuber ..... 160/277
6,918,425 B1 * 7/2005 Nien ..... 160/172 R
6,932,140 B1 * 8/2005 Ni ..... 160/172 R
2005/0082019 A1 * 4/2005 Nien ..... 160/178.2

* cited by examiner

*Primary Examiner*—Blair M. Johnson
(74) *Attorney, Agent, or Firm*—Troxell Law Office, PLLC

(57) ABSTRACT

A Venetian blind operated with a non-pull cord structure includes a blind embodiment, a lower beam having a pivot hole disposed at the bottom side of each end thereon, and a control unit and a sealing cap to be sequentially adapted to each end of the lower beam thereof wherein the control unit has a housing cavity indented at one side thereof to which the sealing cap is joined at one side in sealing engagement therewith. At one inner side of the housing cavity thereof is disposed a sloped and serrated guiding face correspondingly matched to a retaining gear element which is abutted against a retaining shaft adapted to a coupling rod and a fixing rod of the housing cavity and the sealing cap thereof respectively to clamp tight a left/right retaining cord of the blind embodiment there-between before the left/right retaining cord is led through the pivot hole of the lower beam and fixed to a windowsill at the bottom end thereof. In operation, the lower beam is tilted upwards at one side to detach the left/right retaining cord from the clamping location thereof so that the blind embodiment can be adjusted upwards or downwards before the lower beam is horizontally set right to clamp tight the left/right retaining cord via the control unit thereof and relocate the blind embodiment at an adjusted position thereby, precisely gathering up or unfolding the blind embodiment in an easy and fast manner without any pull cords applied thereon so as to protect the safety of children in the household.

4 Claims, 3 Drawing Sheets

VENETIAN BLIND OPERATED WITH NON-PULL CORD STRUCTURE

BACKGROUND OF THE INVENTION

The present invention is related to a Venetian blind operated with a non-pull cord structure, including a control unit and a sealing cap sequentially adapted to each end of a lower beam of a blind embodiment wherein the control unit has a housing cavity indented at one side thereof to which the sealing cap is joined at one side in sealing engagement therewith; whereby, the lower beam is tilted upwards at one side to detach a left/right retaining cord from the clamping location of a retaining gear element and a retaining shaft adapted at the housing cavity therein so that the blind embodiment can be adjusted upwards or downwards before the lower beam is horizontally set right to clamp tight the left/right retaining cord via the control unit and relocate the blind embodiment at an adjusted position thereby, precisely gathering up or unfolding the blind embodiment in an easy and fast manner without any pull cords applied thereon to achieve the best using condition thereof.

A conventional Venetian blind is usually made up of a volute wheel unit in cooperation with pull cords and T-shaped cords, which is not only tediously complex in assembly, but also quite dangerous to children in the household. When the Venetian blind is gathered up, pull cords are suspended downwards for a certain length outside the blind thereof. Children playing around the blind may easily get caught by the suspending pull cords. In case the blind is careless unfolded, the withdrawing pull cords might hurt or even strangle the children got caught in them. Thus, the conventional Venetian blind poses a potential danger to children in the household.

SUMMARY OF THE PRESENT INVENTION

It is, therefore, the primary purpose of the present invention to provide a Venetian blind operated with a non-pull cord structure, including a control unit and a sealing cap sequentially adapted to each end of a lower beam of a blind embodiment wherein the control unit has a housing cavity indented at one side thereof to which the sealing cap is joined at one side in sealing engagement therewith; whereby, the lower beam is tilted upwards at one side to detach a left/right retaining cord from the clamping location of a retaining gear element and a shaft post adapted at the housing cavity therein so that the blind embodiment can be adjusted upwards or downwards before the lower beam is horizontally set right to clamp tight the left/right retaining cord via the control unit and relocate the blind embodiment at an adjusted position thereby, precisely gathering up or unfolding the blind embodiment in an easy and fast manner to achieve the best using condition thereof.

It is, therefore, the secondary purpose of the present invention to provide a Venetian blind operated with a non-pull cord structure wherein the left/right retaining cord clamped tight by the retaining gear element and the retaining shaft of the control unit thereof is led through a pivot hole disposed at the bottom side of each end of the lower beam and fixed to a windowsill at the bottom end, providing a non-pull cord Venetian blind so that children playing around won't get caught or strangled by the left/right retaining cord to effectively protect the safety of people in the household.

It is, therefore, the third purpose of the present invention to provide a Venetian blind operated with a non-pull cord structure wherein, via two control units adapted at both ends of the lower beam to hold the left and the right retaining cords therein, the blind embodiment is easily and precisely gathered up or unfolded without any other volute wheel unit, pull cords, or T-shaped cords applied thereon, economically reducing the parts of assembly as well as the costs of materials, and effectively boosting the competitive power of the present invention in the market.

DETAILED DESCRIPTION OF THE PREFERRED EMBODIMENTS

Figure 1:
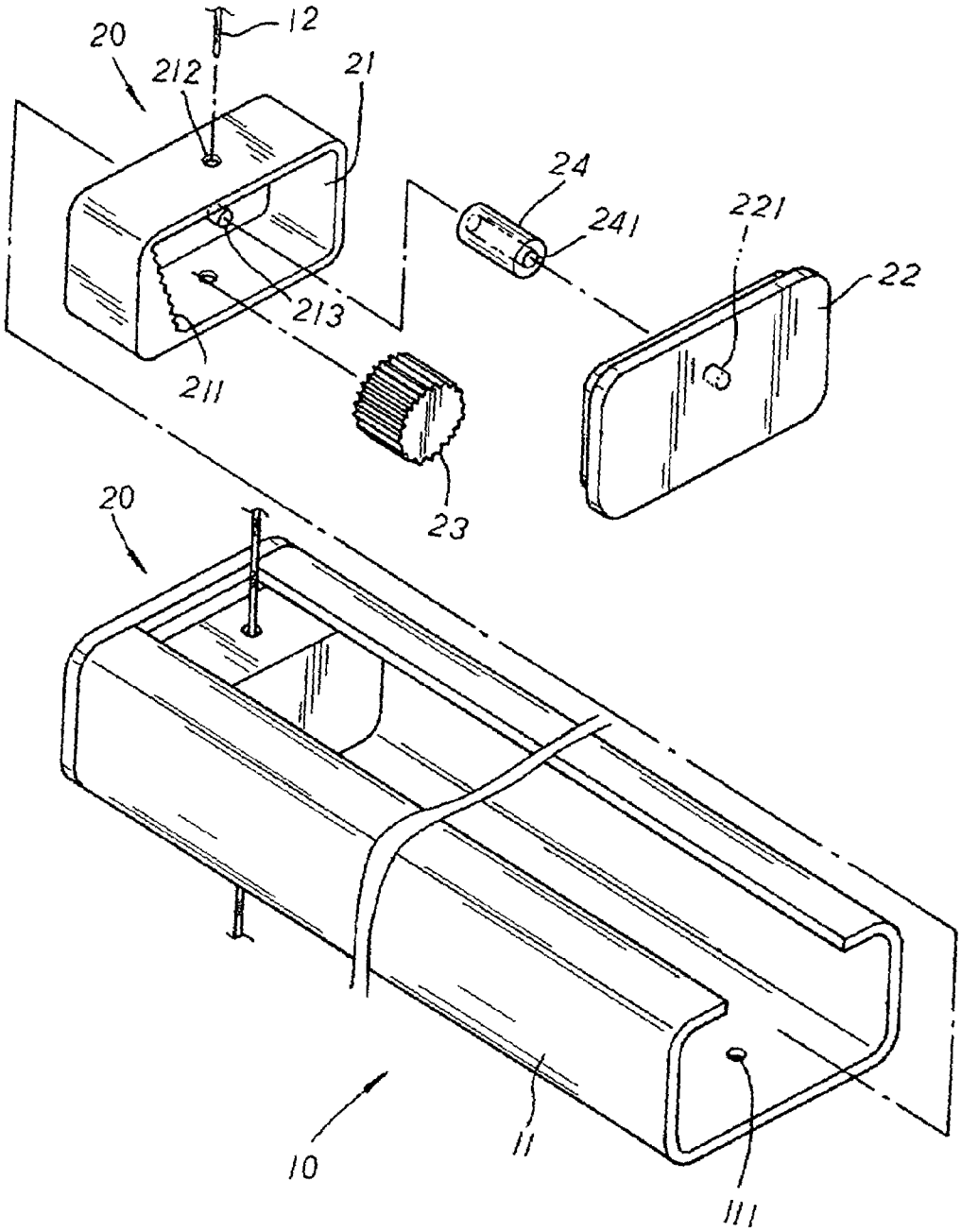
FIG. 1 is a perspective exploded view of the present invention.
Figure 2:
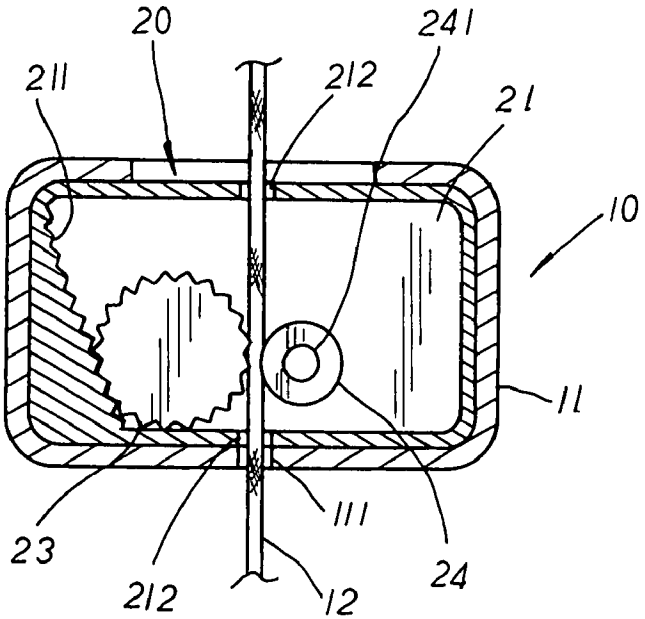
FIG. 2 is a cross sectional view of the present invention in assembly.
Figure 4:
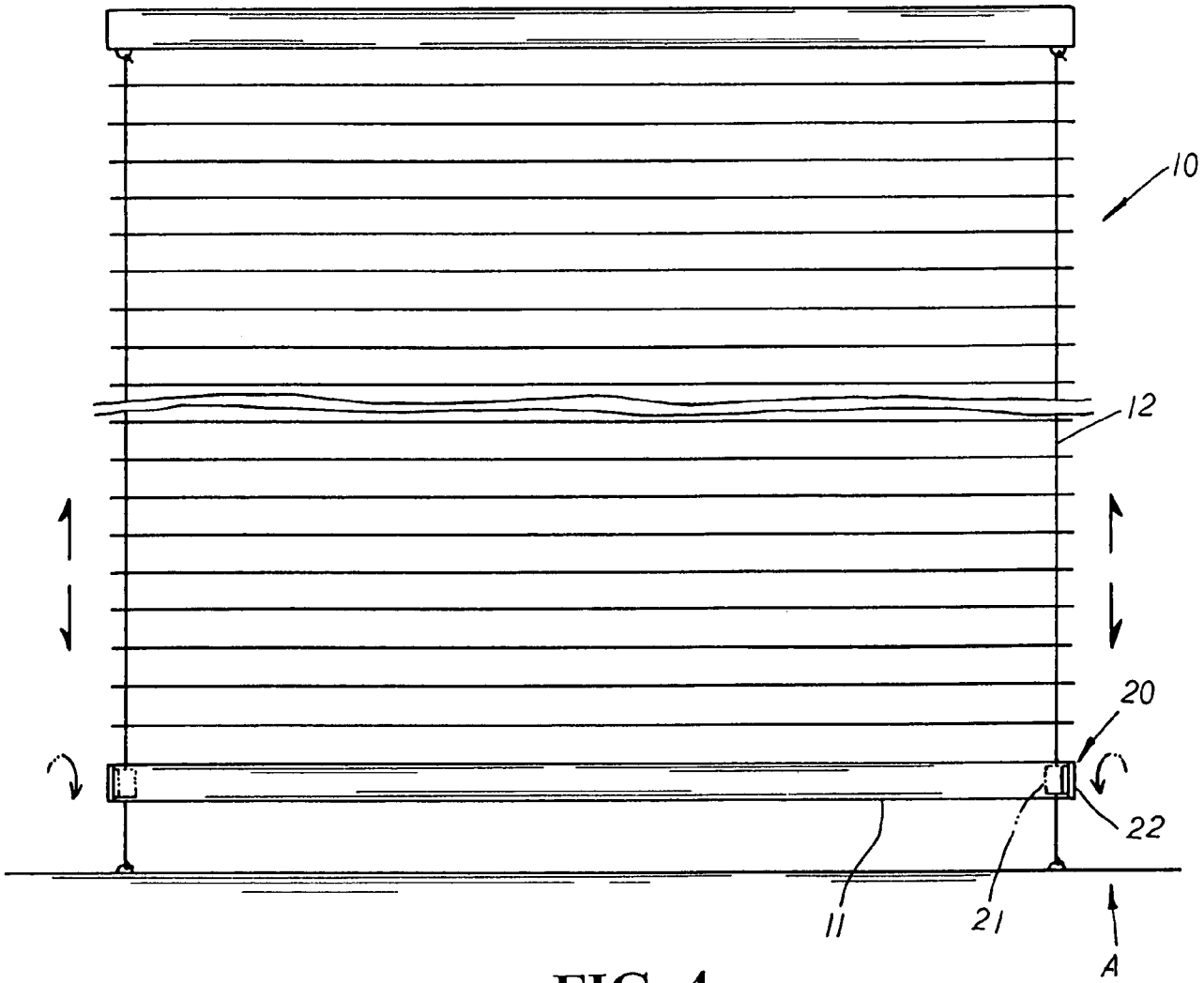
FIG. 4 is a diagram showing a blind embodiment of the present invention pushed upwards or drawn downwards in practical use.

Please refer to FIGS. 1 to 2 inclusive. The present invention is related to a Venetian blind operated with a non-pull cord structure, comprising a blind embodiment 10, a lower beam 11 having a pivot hole 111 disposed at the bottom side of each end thereon, and a control unit 20 and a sealing cap 22 to be sequentially adapted to each end of the lower beam 11 thereof. The control unit 20 is provided with a housing cavity 21 indented at one side thereof to which the sealing cap 22 is joined at one side in sealing engagement therewith. At one inner side of the housing cavity 21 thereof is disposed a sloped and serrated guiding face 211 correspondingly matched to a retaining gear element 23 adapted at the housing cavity 21 therein. A through hole 212 is disposed at the top and bottom sides of the housing cavity 21 respectively in communication with the pivot hole 111 of the lower beam 11 for a left/right retaining cord 12 led through both lateral sides of the blind embodiment 10 thereof respectively to be passed there-through before fixed to a windowsill A at the bottom end thereof as shown in FIG. 4. A coupling rod 213 and a fixing rod 221 are symmetrically protruding at the corresponding inner side of the housing cavity 21 and the sealing cap 22 thereof respectively for a retaining shaft 24 with a central through hole 241 disposed thereon to be adapted thereto with the left/right retaining cord 12 precisely clamped tight at the retaining gear element 23 and the retaining shaft 24 there-between for location thereby as shown in FIG. 2.

Figure 3:
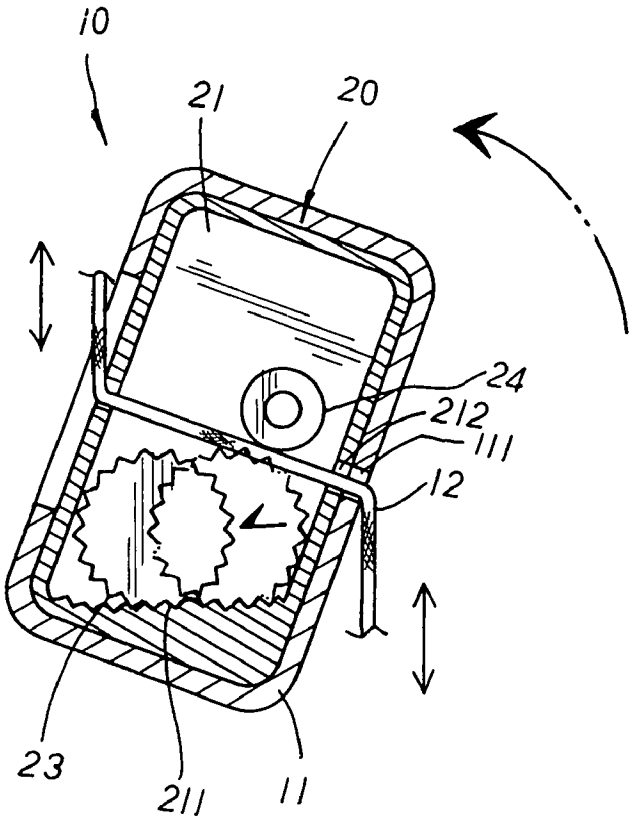
FIG. 3 is a cross section view of the present invention in operation.

Please refer to FIGS. 3 to 4 inclusive. The lower beam 11 is tilted upwards at one side to slide the retaining gear element 23 along the serrated guiding face 211 thereon till moved to the other side thereof. Meanwhile, a space is revealed at the retaining gear element 23 and the retaining shaft 24 therebetween to detach the left/right retaining cord 12 thereof from the clamping location thereof so that the blind embodiment 10 is able to be moved by the bottom side of the lower beam 12 and adjusted upwards or downwards along the left/right retaining cords 11 thereof into a proper position. The lower beam 11 tilted upwards is then released and horizontally set right to slide downwards the retaining gear element 23 via the sloped and serrated guiding face 211 thereof till abutted against the retaining shaft 24 with the left/right retaining cords 11 clamped tight there-between to relocate the blind embodiment 10 at the adjusted proper position thereby. Thus, the blind embodiment 10 is precisely adjusted and relocated at the proper position in an easy and fast manner to achieve the best using condition thereof. Besides, the left and the right retaining cords 11 each led through the through holes 212 and the pivot hole 111 of the housing cavity 21 and the lower beam 11 respectively are led straight downwards to be fixed to a windowsill A at the bottom ends thereof, providing a Venetian blind operated with non-pull cord structure so that children playing around won't get caught or strangled by the retaining cords to effectively protect the safety of people in the household.

What is claimed is:

1. A Venetian blind comprising a non-pull cord operated raising and lowering structure, including a plurality of slats, a lower beam at the lower end of the slats having a pivot hole disposed at the bottom side of each of two ends thereon, and a control unit and a sealing cap attached to each respective end of the lower beam thereof wherein the control unit is provided with a housing cavity indented at one side thereof to which the sealing cap is joined at one side in sealing engagement therewith; at one inner side of the housing cavity thereof is disposed a serrated guiding face correspondingly matched to a retaining gear element which is movable to a position abutted against a retaining shaft at one side which clamps tight a respective left or right retaining cord of the blind there-between, and a through hole is disposed at the top and bottom sides of the housing cavity respectively in communication with the pivot hole of the lower beam for the left or right retaining cord to be passed there-through which is fixed to a windowsill at the bottom end thereof.

2. The Venetian blind operated with a non-pull cord structure as claimed in claim 1 wherein the serrated guiding face disposed at one inner side of the housing cavity thereof is defined by a slope so that, when the lower beam is extended horizontally in normal condition, the retaining gear element can slide downwards to abut against the retaining shaft with the left or right retaining cord clamped tight there-between to locate the blind embodiment at a proper position thereby.

3. The Venetian blind operated with a non-pull cord structure as claimed in claim 1 wherein a coupling rod and a fixing rod are symmetrically protruding at the corresponding inner side of the housing cavity and the sealing cap thereof respectively for the retaining shaft thereof to be attached thereto.

4. The Venetian blind operated with a non-pull cord structure as claimed in claim 3 wherein the retaining shaft is provided with a central through hole to be led through the coupling rod and the fixing rod of the housing cavity and the sealing cap thereof respectively to locate the retaining shaft thereby.

* * * * *